United States Patent [19]

Moeller

[11] Patent Number: 4,906,951

[45] Date of Patent: Mar. 6, 1990

[54] BIREFRINGENT CORRUGATED WAVEGUIDE

[75] Inventor: Charles P. Moeller, Del Mar, Calif.

[73] Assignee: United States Department of Energy, Washington, D.C.

[21] Appl. No.: 310,555

[22] Filed: Feb. 15, 1989

[51] Int. Cl.[4] ..... H01P 1/165; H01P 3/123

[52] U.S. Cl. ..... 333/21 A; 333/242

[58] Field of Search ..... 333/21 R, 21 A, 239, 333/242

[56] References Cited

U.S. PATENT DOCUMENTS

| | | | |
|---|---|---|---|
| 3,201,723 | 8/1965 | Martin et al. | 333/239 X |
| 4,305,051 | 12/1981 | Hai | 333/242 X |
| 4,429,290 | 1/1984 | Devan | 333/242 X |
| 4,673,905 | 6/1987 | Yamawaki et al. | 333/239 |
| 4,680,558 | 7/1987 | Ghosh et al. | 333/242 X |

*Primary Examiner*—Paul Gensler

*Attorney, Agent, or Firm*—Clifton E. Clouse, Jr.; Roger S. Gaither; William R. Moser

[57] ABSTRACT

A corrugated waveguide having a circular bore and noncircularly symmetric corrugations, and preferably elliptical corrugations, provides birefringence for rotation of polarization in the $HE_{11}$ mode. The corrugated waveguide may be fabricated by cutting circular grooves on a lathe in a cylindrical tube or rod of aluminum of a diameter suitable for the bore of the waveguide, and then cutting an approximation to ellipses for the corrugations using a cutting radius $R_0$ from the bore axis that is greater than the bore radius, and then making two circular cuts using a radius $R_1$ less than $R_0$ at centers $+b$ and $-b$ from the axis of the waveguide bore. Alternatively, stock for the mandrel may be formed with an elliptical transverse cross section, and then only the circular grooves need be cut on a lathe, leaving elliptical corrugations between the grooves. In either case, the mandrel is first electroplated and then dissolved leaving a corrugated waveguide with noncircularly symmetric corrugations. A transition waveguide is used that gradually varies from circular to elliptical corrugations to couple a circularly corrugated waveguide to an elliptically corrugated waveguide.

6 Claims, 4 Drawing Sheets

BIREFRINGENT CORRUGATED WAVEGUIDE

The Government has rights in this invention pursuant to Contract No. DE-AC03-84ER51044 awarded by the United States Department of Energy.

BACKGROUND OF THE INVENTION

The invention relates to a birefringent element for use in corrugated waveguide of circular cross section propagating the $HE_{11}$ mode, and to a method of manufacturing such a waveguide.

It is frequently desirable in a transmission system to have a birefringent element, either to produce a circular or elliptic polarization, or to eliminate ellipticity introduced by another element, such as a bend in the waveguide. One of the generally accepted desirable properties of the $HE_{11}$ mode in a corrugated waveguide is its insensitivity to deformations of cross section as compared to a smooth wall waveguide, (P. J. B. Clarricoats, A. D. Olver, C. G. Parini and G. T. Poulton, in "Proceedings of the Fifth European Microwave Conference," Hamburg, F.R.G., pp. 56–60, September 1975.) For that reason propagation in the $HE_{11}$ mode through a circularly symmetric corrugated waveguide is often used. However, generation of a circular or elliptical polarization from a linear polarization has not heretofore been accomplished directly in a corrugated waveguide used for propagation in the $HE_{11}$ mode. Instead, any required rotation of the polarization has been achieved before conversion to the $HE_{11}$ propagation mode by using a smooth wall waveguide of elliptic cross section propagating the $TE_{11}$ or $TM_{11}$ mode as a birefringent element, (J. L. Doane, "Int. J. of Electronics," 61, 1109–1133, 1986.) After the change in polarization has been made, conversion to the $HE_{11}$ mode may be made for propagation through circularly symmetric corrugated waveguides.

SUMMARY OF THE INVENTION

An object of this invention is to provide a birefringent corrugated waveguide having noncircularly symmetric corrugations for polarization rotation in the $HE_{11}$ mode.

In accordance with the present invention, a corrugated waveguide is provided with a circular bore for propagation of the $HE_{11}$ mode and uniformly spaced noncircularly symmetric corrugations for polarization rotation in the $HE_{11}$ mode by giving the depth of the corrugations of the waveguide an angular dependence. Ideally, the admittance for axial currents at the corrugated wall required to rotate the polarization of the $HE_{11}$ mode is $$Y_s(\theta)=i(\epsilon/Z_0)\cos(2\theta),$$

where i is $\sqrt{-1}$, $Z_0$ is free space impedance (377 ohms), $\epsilon$ is the ellipticity of the wall admittance and represents a deformation of the corrugation, not of the circular waveguide bore, and $\theta$ is the angular position, as shown in FIG. 1*a*. Thus, in accordance with the present invention, the corrugation depth is provided with an approximately elliptical variation around an average depth, where that average depth is the depth of corrugation in a circularly symmetric waveguide to which this noncircularly symmetric corrugated waveguide is connected; that average depth would be approximately one quarter wavelength at the operating frequency while the circular inner bore is several wavelengths in diameter.

Such an elliptically corrugated waveguide may be fabricated by machining a mandrel having an outer surface corresponding to the noncircularly symmetric corrugations desired in a waveguide, electroplating the mandrel with a suitable conductive material, such as copper, and then dissolving the mandrel. For machining the mandrel from cylindrical stock while turning it on its axis on a lathe, circular grooves are first cut to a depth required for the inner bore of the waveguide, and then noncircular corrugations are cut between the grooves by first turning the cylindrical stock on its axis while cutting at a radius $R_0$, the maximum dimension of the corrugations, then making two more successive cuts, first by turning the stock on an axis offset a distance +b from the stock axis while cutting at a radius $R_1$, and then by turning the stock on an axis offset at a distance −b from the stock axis while cutting at the same radius $R_1$, thus providing a corrugation depth with an approximately elliptical variation. More ideal corrugations may be formed by starting with stock having the approximately elliptical transverse cross section for the mandrel, as could be produced by extrusion or with a numerically controlling milling machine, and then cutting on a lathe only the circular grooves.

DETAILED DESCRIPTION OF THE INVENTION

Figure 1C:
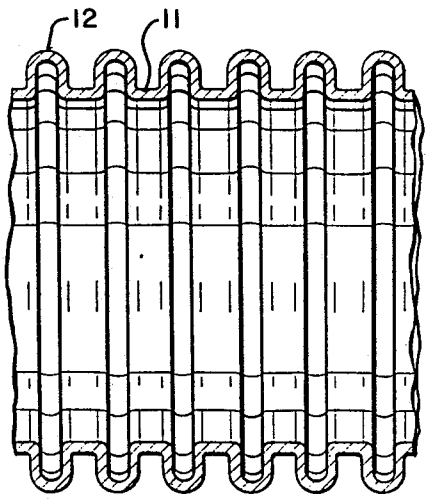
FIG. 1*c* is also an axial cross section of the corrugated waveguide of FIGS. 1*a, b* and *c* taken along a line 1*c*—1*c* in FIG. 1*a* at 90° from the line 1*b*—1*b* to emphasize the elliptical shape of the corrugations.
Figure 1B:
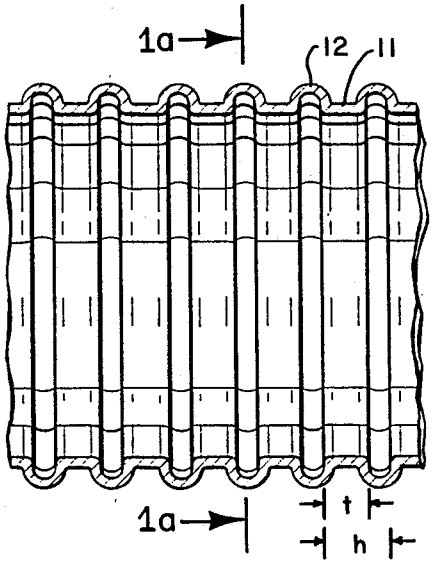
FIG. 1*b* is in turn an axial cross section of the corrugated waveguide taken along a line 1*b*—1*b* in FIG. 1*a*.
Figure 1A:
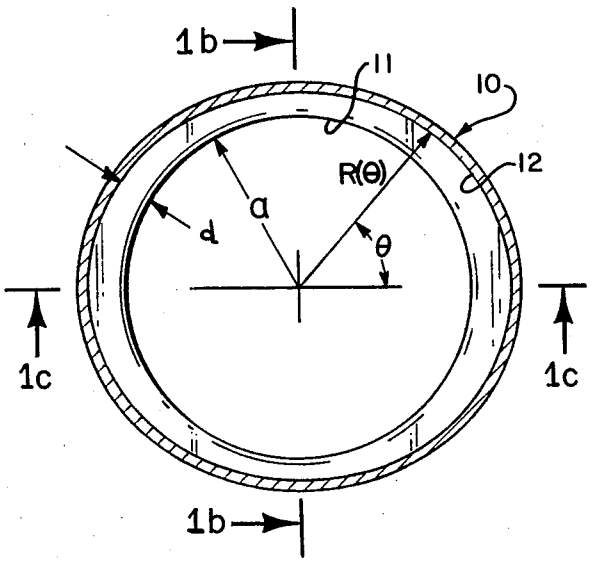
FIG. 1*a* is a transverse cross section of a corrugated waveguide taken along a line 1*a*—1*a* in FIG. 1*b*.

Referring to FIGS. 1*a, b* and *c* a waveguide 10 having a cylindrical bore 11 and elliptical corrugations 12 provides birefringence in the $HE_{11}$ mode. The elliptical corrugations are shown in a transverse cross section taken along a line 1*a*—1*a* in FIG. 1*b*. Note that the major axis is shown horizontal in FIG. 1*a* and into the paper in FIG. 1*b*. Axial cross sections taken along lines 1*b*—1*b* and 1*c*—1*c* in FIG. 1*a* are shown in FIGS. 1*b* and 1*c* adjacent to each other for comparison of the depth of corrugation along the major and minor axes of the elliptical corrugations, i.e., the depth of corrugation along the line 1*c*—1*c* of FIG. 1*a* shown in FIG. 1*c* as compared to the depth of corrugations along the line 1b—1b of FIG. 1a shown in FIG. 1b.

The cylindrical bore 11 has a constant radius a throughout the length of the corrugated waveguide 10, and the elliptical corrugations 12 have a radius $R(\theta)$, i.e., has a radius R that is a function of a coordinate angle $\theta$ that varies through 360° as shown in FIG. 1a.

In order to appreciate the benefits of the present invention in respect to giving the corrugation depth of a waveguide an angular dependence, it is necessary to examine quantitatively the effect of the corrugations on wave propagation. A comparison between symmetrically corrugated and non-symmetrically corrugated guides can then be made.

Wave propagation in a corrugated waveguide is often treated by modeling the corrugated wall as an anisotropic conducting surface that is a perfect conductor in the transverse direction, but reactive in the direction of the waveguide axis. (C. Dragone, Bell Systems Tech. J., 56, 835–868, 1977; J. L. Doane, "Propagation and Mode Coupling in Corrugated and Smooth-Wall Circular Waveguide," Infrared and Millimeter Waves, (K. J. Button, Ed.), Academic Press, Vol. 13, Chapter 5, New York, 1985). The boundary conditions at such a surface require the tangential electric field $E_\theta$ to equal zero, but allow an axial electric field $E_z$. If the axial surface current is I (in amperes per meter) and the axial wall admittance is $Y_s$ (in ohms$^{-1}$), then $I=E_zY_s$. For the usual circular corrugated waveguide, the surface admittance $Y_s$ is assumed to be independent of angle.

For the present invention, $Y_s$ is made a function of the coordinate angle $\theta$ as defined in FIG. 1a. Specifically, an elliptical dependence $Y_s(\theta)=i(\epsilon/Z_0)\cos(2\theta)$ is introduced, where i is $\sqrt{-1}$, $Z_0$ is the free space impedance (377 ohms), $\theta$ the angular coordinate, and $\epsilon$ the ellipticity of the surface admittance due to the corrugations. $Y_s=0$ corresponds to an electrical depth of one-quarter wavelength, so the angular dependence is a perturbation around this depth. If the average value of $Y_s(\theta)$ were not zero, the analysis would become more complex, but the essential result would not change.

Since the present invention is concerned with the $HE_{11}$ mode of propagation, the angular dependence of which is $\cos(\theta)$, the wave fields can be written in terms of the series $$E_z = \sum_{m=1}^{\infty} A_m J_m(kr)\sin(m\theta), \tag{1a}$$

$$B_z = \sum_{m=1}^{\infty} B_m J_m(kr)\cos(m\theta)/c, \tag{1b}$$

where k is the transverse wave number, r the radial coordinate, z the axial coordinate, $J_m$ the Bessel function of order m, and c the speed of light. Using the previously given boundary conditions and equating terms of equal angular dependence, an infinite system of linear, homogeneous equations in the $A_m$'s is obtained. By truncating the system at some value of m, a determinate for the system of equations, correct to order m in $\epsilon$ is obtained, which relates k to $\epsilon$.

Small Deformations

The first order (in $\epsilon$) solution, for the usual case of $k_0a \gg 1$, is $$ka=p_{01}[1\pm\epsilon/(2k_0a)], \tag{2}$$

where $k_0=\omega/c$, $\omega$ is the applied angular frequency, a is the inner bore radius, and $J_0(p_{01})=0, p_{01}=2.405$. The higher order solutions do not deviate significantly from this result until $\epsilon>0.2$. When $\epsilon=0$, Equation (2) gives $ka=p_{01}$, which is the usual result for symmetric corrugations when $Y_s=0$ and $k_0a$ 1.

Figure 2A:
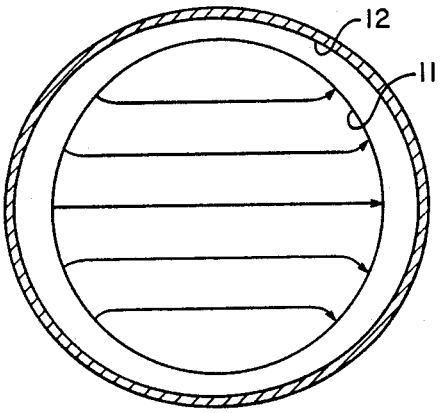
FIGS. 2*a* and 2*b* represent the two $HE_{11}$ normal modes of the elliptically corrugated waveguide of FIG. 1.
Figure 2B:
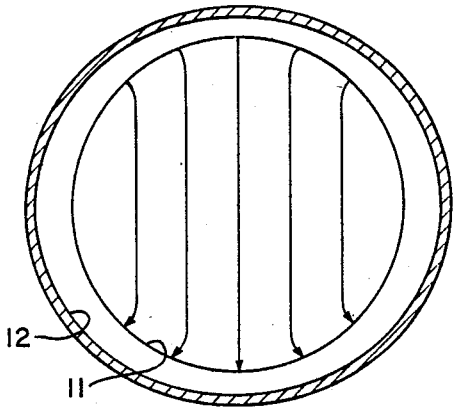

Using the value of ka from Equation (2), the difference in axial wave number of the two orthogonal polarizations, shown in FIGS. 2a and 2b is $$\Delta\beta=p_{01}^2\epsilon/(k_0^2a^3), \tag{3}$$

where $\beta$ is the axial wave number. This shows that the $HE_{11}$ mode waveguide can be made sufficiently birefringent to achieve a $\pi/2$ phase shift between the two polarizations in a practical length. Equation (3) is valid for $\epsilon$ as large as 0.5.

In order to fabricate a working device or make comparisons with other types of polarizers, it is necessary to relate $Y_s$ to a physical corrugation depth. The approximate relation between $Y_s$ and $d\equiv R(\theta)-a$ (see FIG. 1a) is given, using Equation (7) of Dragone at page 839, as $$Y_s=\cot(k_od)/[(1-t/h)iZ_o],$$

where t and h are defined in FIG. 1b. For circularly symmetric corrugated waveguide, $d_o$ would be such that $$k_od_o=\pi/2$$

so that $\cot(k_od_o)=0$.

A perturbation $d=d_o+a\delta\cos 2\theta$ then gives approximately $\delta=(1-t/h)\epsilon/k_oa$, valid for $(1-t/h)\epsilon\leqq 0.3$, in which case the physical perturbation of the corrugation depth is also elliptical. Since typically $(1-t/h)\approx 0.3$, the approximation is valid for $\epsilon\leqq 1$.

Equation (3) can then be rewritten as $$\Delta\beta=P_{01}^2\delta/[k_oa^2(1-t/h)], \cong 19.3\delta k_oa^2 \tag{3'}$$

which can be compared directly with expressions to follow for elliptical $TE_{11}$ and $HE_{11}$ mode waveguides, since $\delta$ has the same meaning in all cases.

Comparison with Other Approaches

The basic result set forth above is to be compared to the case of a corrugated guide given an elliptic deformation in both inner (a) and outer (b) radii, so that $a=a_0[1+\delta\cos(2\theta)]$ and $b=b_0[1+\delta\cos(2\theta)]$. By an analysis similar to the previous one, the following equation is obtained:

$$ka=p_{01}[1\pm\delta^2(\tfrac{3}{4}-p_{01}^2/8)], \tag{4}$$

giving $\Delta\beta\approx 0.75\delta^2/(k_0a^2)$.

Since $\delta$, which now refers to the overall ellipticity of the waveguide, is typically kept small ($\delta<0.1$), Equation (4) can only give a very small value of birefringence compared to Equation (3'), since $\delta$ appears in Equation (4) to the second power, while Equation (3') contains $\delta$ only to the first power. That is why Doane, cited above, does not consider deforming the corrugated guide to make it birefringent, but rather deforms a smooth walled waveguide carrying a $TE_{11}$ or $TM_{11}$ mode, and then converts to $HE_{11}$ after the change from linear to circular polarization has been made. An expression analogous to Equations (3) and (4) for the smooth wall waveguide carrying the $TE_{11}$ mode is $$\Delta\beta = \delta \frac{p'^2_{11}}{k_0 a^2} \frac{p'^2_{11}+1}{p'^2_{11}-1} \approx 6.23\delta/(k_0 a^2), \quad (5)$$

where $dJ_1/dx=0$ for $x=p'_{1n}$, and $p'_{11}=1.841$.

To see the practical consequences of Equations (3) to (5), consider the following numerical example with $a=1$ cm and $k_0=12.57(\omega/2\pi=60$ GHz). For Equation (3), a value of $\epsilon=0.5$ is entirely acceptable (since it represents a deformation of the corrugation, not the waveguide bore), while the Equations (4) and (5) a value of $\delta=0.05$ for the ellipticity of the entire waveguide would be an upper limit for a highly overmoded waveguide. From Equation (3), $\Delta\beta=1.83\times10^{-2}$ cm$^{-1}$, from Equation (4), $\Delta\beta=1.49\times10^{-4}$ cm$^{-1}$, while from Equation (5), $\Delta\beta=2.48\times10^{-2}$ cm$^{-1}$. It is evident that the waveguide of the present invention defined by Equation (3) and the prior art deformed smooth wall waveguide defined by Equation (5) are comparable, while the deformed corrugated $HE_{11}$ guide has very little birefringence.

In order to convert from linear to circular polarization, the converter length L has to satisfy $\Delta\beta L=\pi/2$. The devices described by Equations (3) to (5) would have to have lengths of, respectively, 85.8, 10,542, and 63.3 cm. It is apparent that simply deforming the cross section of the corrugated waveguide, Equation (4), is ineffective in producing birefringence, while the proposed invention, Equation (3), is comparable in effectiveness to the conventional approach for the $TE_{11}$ mode in a smooth wall waveguide, Equation (5), and has the advantage that it can be placed anywhere in the $HE_{11}$ mode system.

Experimental Confirmation

In order to test the Equations (2) and (3) above, several short sections of elliptical corrugated waveguide were constructed with corrugations made using a technique described below with reference to FIGS. 2a and 2b. By making these sections one-half a nominal guide wavelength long and placing shorts at the end, a resonant cavity was formed. If the corrugations were circular, the polarizations of both normal modes shown in FIGS. 2a and 2b would have the same resonant frequency. With elliptic corrugations as shown, however, the frequencies are split, the splitting $\Delta\omega$ given by $$\Delta\omega/\omega=\epsilon p_{01}^2(c/\omega a)^3, \quad (6)$$

derived by using Equation (2).

For a case with $a=4.318$ cm, $\omega/2\pi=12$ GHz, and $\epsilon=0.47$, the measured value of $\Delta\omega/\omega$ was $2.0\times10^{-3}$, while Equation (6) gives $\Delta\omega/\omega=2.13\times10^{-3}$, which is reasonable agreement for the first-order expression.

Fabrication Technique

An important aspect of the present invention is a method of manufacturing a corrugated waveguide having noncircularly symmetric corrugations. In the prior art, a conventional circular corrugated waveguide is made, when high accuracy is required, by cutting circular grooves in an aluminum rod or tube with a lathe to a depth required for the inside bore. This mandrel is then electroplated and the aluminum rod or tube is dissolved leaving only the electroplated shell.

Figure 3A:
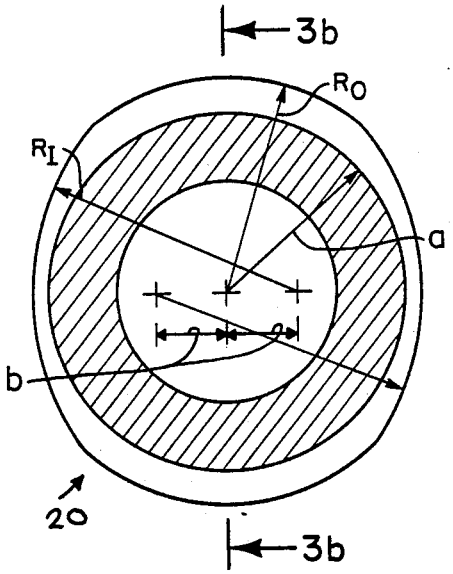
FIGS. 3*a* and 3*b* are transverse and axial cross sections, respectively, of a mandrel made from cylindrical stock using a conventional lathe from which the birefringent waveguide of FIGS. 1*a, b* and *c* can be made.

For a nonconventional, noncircularly symmetric waveguide, which is the object of the present invention, the technique just described for a conventional circular waveguide is varied, as will now be described with reference to FIGS. 3a and 3b, which is by turning on its axis an aluminum stock in the shape of a rod, or preferably a tube, and cutting an annular groove to a depth required for the inside bore and then cutting noncircularly symmetric corrugations which replace the ideal ellipse of the corrugations shown in FIGS. 1a, 1b and 1c. This is done by cutting on the lathe while turning the stock on three centers equally spaced by a distance b, with the turning center in the middle on the axis of the stock, as shown in FIG. 3a, and cutting first at a radius $R_0$ while turning on the axis of the stock and then at a radius $R_1$ while turning on the centers at $+b$ and $-b$, where $R_1-|b|$ must be $<R_0$. A curve formed by the three cuts can be described by an even series defining radii from the axis of the stock $$r=a_0+a_1\cos(2\theta)+a_2\cos(4\theta)+\ldots.$$

Figure 3B:
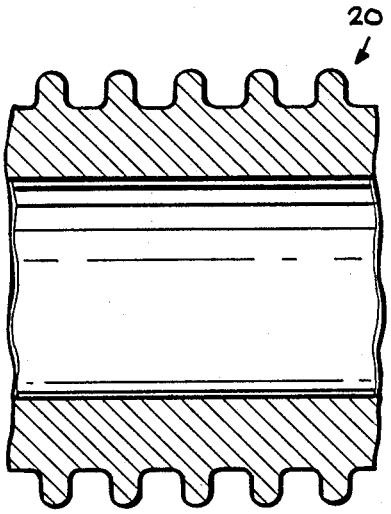

Thus, to form a mandrel 20 shown in FIGS. 3a and 3b, the first of the three cuts on a lathe use the axis of an aluminum tube for cutting at a radius $R_0$ while turning. The second and third cuts made in succession use a radius $R_1$ and turning the tube on a center offset in diametrically opposite directions from the tube axis by a distance b, as shown in FIG. 3a. The quantities $R_0$, $R_1$, and b can be adjusted to produce given values of $a_0$ and $a_1$ and minimize $a_2$, so that $Y_s(\theta)$ has approximately a $\cos 2\theta$ dependence and that the average value of $Y_s=0$.

In summary, by first cutting the outer radius to $R_0$ and grooves to depth a, and then moving the turning center first to a position at $+b$, cutting at the radius $R_1$, and then to a second position at $-b$, and again cutting at the radius $R_1$, the noncircularly symmetric corrugations on the mandrel 20 can be made to approximate elliptical corrugations. Sharp corners can be chamfered in this procedure by shaping the cutting tool appropriately. The mandrel is then electroplated and the aluminum tube is dissolved, as in the prior art technique for a conventional circular corrugated waveguide.

It is also recognized by the inventor that a numerically controlled milling machine can be used to give a true elliptic dependence to the corrugations of the mandrel. However, the maximum length of the mandrel that may be milled would be limited.

Figure 4A:
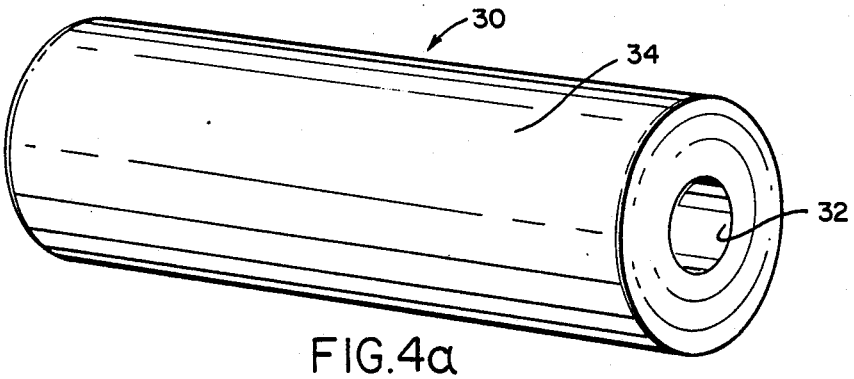
FIGS. 4*a* through 4*d* illustrate successive steps of a method for producing a corrugated waveguide having noncircularly symmetric corrugations using a mandrel cut on a lathe from a stock having an elliptical cross section.
Figure 4B:
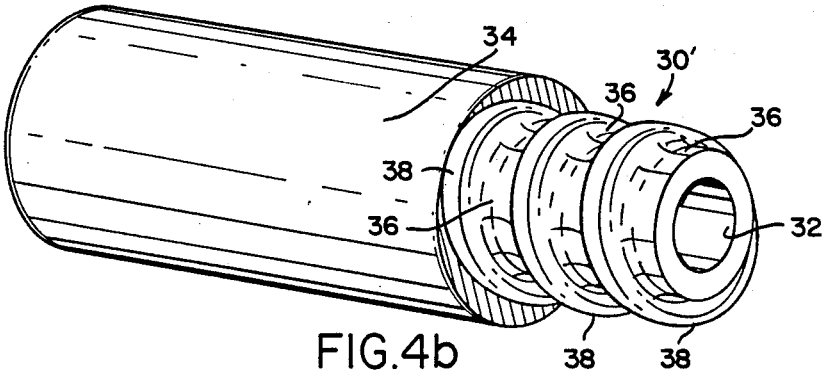
Figure 4C:
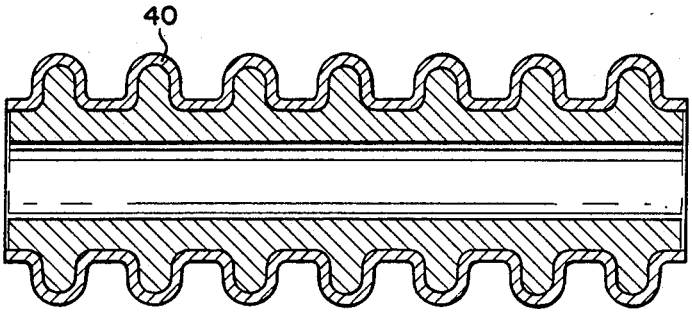
Figure 4D:
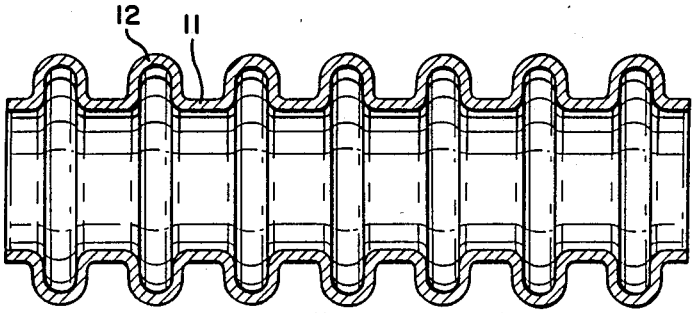

An alternative method for producing waveguides with noncircular symmetric corrugations that are more nearly ideal ellipses is illustrated in FIGS. 4a through 4d. Starting with a tube 30 having a bore 32 and a cylindrical surface 34 centered on the axis of the bore 32, as shown in FIG. 4a, a numerically controlled milling machine may be used to cut grooves 36 to a depth required for the inner circular bore of the waveguide to be produced, as well as to cut the elliptical corrugations 38 shown in FIG. 4b. Chamfered corners are milled at the same time. The elliptically corrugated mandrel 30' shown in FIG. 4b thus machined is then electroplated to produce a coating 40 out of suitable metal, such as copper, to the proper wall thickness desired for the elliptically corrugated waveguide, as shown in an axial cross section in FIG. 4c. The aluminum mandrel is then dissolved with sodium hydroxide leaving the required waveguide with elliptical corrugations as shown in FIG. 4d which illustrates an axial cross section.

Figure 5C:
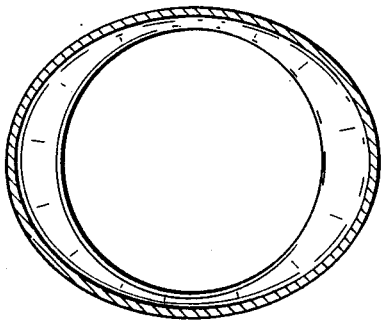
FIGS. 5*a* through 5*d* are sectional views of a waveguide to be used for transition from circularly to elliptically corrugated waveguides and vice versa, with FIGS. 5*a* and 5*c* showing transverse cross sections taken on respective lines 5*a*—5*a* and 5*c*—5*c* in FIG. 5*b*, and FIGS. 5*b* and 5*d* are axial cross sections taken on line 5*b*—5*b* and 5*d*—5*d*, respectively, in FIG. 5*a*.
Figure 5B:
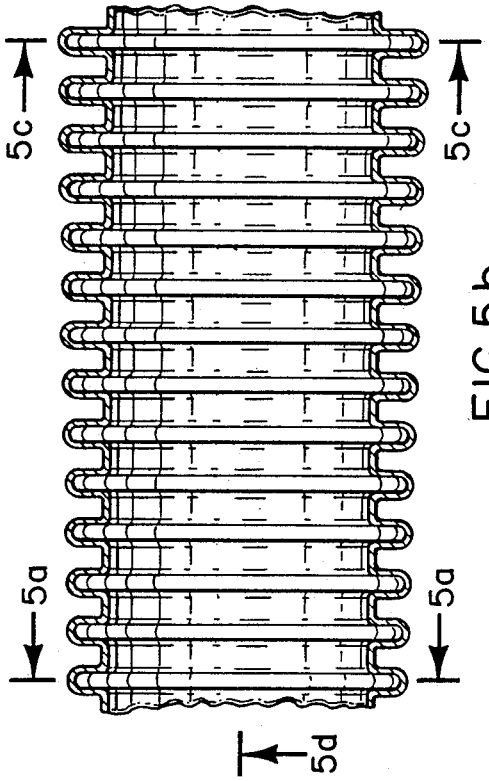
Figure 5D:
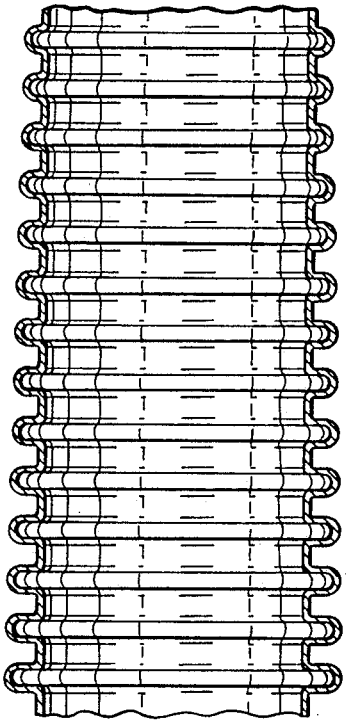
Figure 5A:
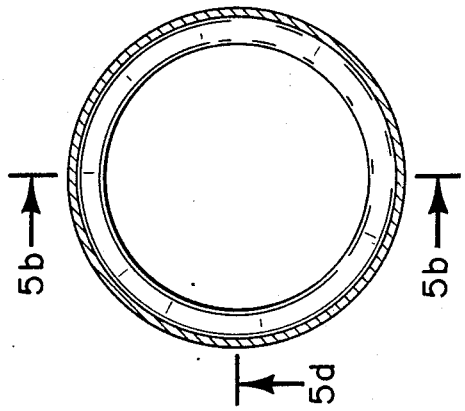

It is further recognized by the inventor that a smooth transition is desired from the elliptically corrugated to the circularly corrugated waveguide, and vice versa, in order to avoid mode conversion in a waveguide having an inner bore several wavelengths in diameter (i.e., a waveguide that is highly overmoded). FIGS. 5*a* through 5*d* illustrate a waveguide for transition from circularly corrugated to elliptically corrugated waveguides. FIG. 5*a* is a transverse cross section taken on a line 5*a*—5*a* in FIG. 5*b* at the circularly corrugated end, and FIG. 5*c* is a transverse cross section taken on a line 5*c*—5*c* in FIG. 5*b* at the elliptically corrugated end. By comparing the axial cross section shown in FIG. 5*b* taken on a line 5*b*—5*b* in FIG. 5*a* with the axial cross section shown in FIG. 5*d* taken on a line 5*d*—5*d* in FIG. 5*a*, it can be seen that the corrugations taper left to right from circular to elliptical.

The foregoing description of the invention has shown that rotating the polarization of the $HE_{11}$ mode can be achieved in a reasonable length by giving the surface admittance of the corrugations a suitable angular dependence. Furthermore, suitable nonsymmetric corrugations can be manufactured using conventional machine tools and electroforming techniques.

What is claimed is:

1. A corrugated waveguide having noncircularly symmetric corrugations centered on the axis of a circular bore for propagation in the $HE_{11}$ mode, said noncircularly symmetric corrugations being uniformly spaced, and said circular bore consisting of circular grooves between said noncircularly symmetric corrugations.

2. A corrugated waveguide having noncircularly symmetric corrugations as defined in claim 1 including a transition waveguide for coupling radiation in the $HE_{11}$ mode into said corrugated waveguide having nonlinearly symmetric corrugations, said transition waveguide having a gradual transition from a circularly corrugated waveguide to a noncircularly symmetric corrugated waveguide.

3. A corrugated waveguide having noncircularly symmetric corrugations as defined in claim 2 including a transition waveguide for coupling radiation in the $HE_{11}$ mode out of said corrugated waveguide having noncircularly symmetric corrugations, said transition waveguide having a gradual transition from a noncircularly symmetric corrugated waveguide to a circularly symmetric corrugated waveguide.

4. A corrugated waveguide having noncircularly symmetric corrugations as defined in claim 1 wherein the depth of each corrugation is a function of $\theta$, where $\theta$ is an angular coordinate of each point on the surface of said corrugation, thereby to produce corrugations with axial wall admittance $Y_s$ as a function of the coordinate angle $\theta$.

5. A corrugated waveguide having noncircularly symmetric corrugations as defined in claim 4, wherein said admittance is given by $$Y_s(\theta) = i(\epsilon/Z_0)\cos(2\theta),$$

where i is $\sqrt{-1}$, $Z_0$ is free space impedance, and $\epsilon$ is the ellipticity of the corrugation surface admittance and represents elliptical deformation of the corrugation.

6. A corrugated waveguide having noncircularly symmetric corrugations as defined in claim 5, wherein the value of said ellipticity $\epsilon$ of the corrugation surface admittance which represents elliptical deformation of the corrugation is $\leqq 1$.

* * * * *